US005386593A

United States Patent [19]

Kleinman

[11] Patent Number: 5,386,593

[45] Date of Patent: Feb. 7, 1995

[54] FIREMAN'S BELT WITH PADDING AND FIRE-RESISTANT CONSTRUCTION

[75] Inventor: H. Leonard Kleinman, Waite Hill, Ohio

[73] Assignee: Ramwear, Inc., Mentor, Ohio

[21] Appl. No.: 828,207

[22] Filed: Jan. 30, 1992

Related U.S. Application Data

[62] Division of Ser. No. 464,302, Jan. 12, 1990.

[51] Int. Cl.[6] ..... A41F 9/00

[52] U.S. Cl. ..... 2/322; 2/311; 2/336; 2/338

[58] Field of Search ..... 2/311, 321, 322, 336, 2/338, 81, 267, 312, 313, 314, 315, 316, 317, 318, 319, 320, 339, 340; 224/252; 482/105; 182/3; 428/921; 57/904

[56] References Cited

U.S. PATENT DOCUMENTS

| | | | |
|---|---|---|---|
| 2,839,020 | 6/1958 | Hopkins | 2/338 |
| 3,086,529 | 4/1963 | Munz et al. | 2/322 |
| 3,374,636 | 3/1968 | Mason | 2/321 |
| 3,536,237 | 10/1970 | Greenman | 224/264 |
| 4,472,839 | 9/1984 | Johansen | 2/322 |
| 4,747,527 | 5/1988 | Trumpower, II | 224/252 |
| 4,847,919 | 7/1989 | Hwang et al. | 2/338 |
| 4,944,043 | 7/1990 | Bush | 2/338 |
| 4,999,853 | 3/1991 | Tanner | 2/321 |
| 5,036,548 | 8/1991 | Grilliot et al. | 2/81 |
| 5,081,719 | 1/1992 | Donnelly | 2/322 |

FOREIGN PATENT DOCUMENTS

| | | | |
|---|---|---|---|
| 1365328 | 5/1964 | France | 224/264 |

OTHER PUBLICATIONS

Gershman, Maurice, M. D., "Self-Adhering Nylon Tapes"; Journal of the American Medical Association, vol. 68, No. 7, p. 930.

*Primary Examiner*—Clifford D. Crowder
*Assistant Examiner*—Gloria Hale
*Attorney, Agent, or Firm*—Fay, Sharpe, Beall, Fagan, Minnich & McKee

[57] ABSTRACT

A pair of suspenders and a belt for use in securing firefighter's pants are manufactured of an inelastic material to prevent the firefighter's pants from sagging. In conventional suspenders, the elastic nature of previous designs tended to lose their strength over the course of time and cause a potentially hazardous and uncomfortable situation in which the firefighter's pants no longer hung at the desired place.

11 Claims, 2 Drawing Sheets

FIREMAN'S BELT WITH PADDING AND FIRE-RESISTANT CONSTRUCTION

This is a divisional of copending application Ser. No. 07/464,302 filed on Jan. 12, 1990.

BACKGROUND OF THE INVENTION

1. Field of Invention

This invention relates to the art of suspenders and belts and more particularly to use of suspenders and belts in connection with firefighter's pants.

2. Description of Related Art

Suspenders have been used to support firefighter's pants. For example, U.S. Pat. No. 4,549,315 to English et al. discloses a heat-resistant bib overall for use by a firefighter which can be supported by suspenders. U.S. Pat. No. 4,118,804 to Freese discloses a suspender end adapted for use in a suspender set wherein the suspender end comprises an elongated strip of flexible material. In the more recent past, some suspender designs have featured suspenders made entirely of elastic materials. Others have featured shoulder straps made of an inelastic material and back straps made of an elastic material.

While these previous designs have functioned more or less satisfactorily, some problems remain. One problem is the propensity of elastic straps to lose their strength over time. The firefighter's pants supported by such elastic straps are heavy. Accordingly, as the elastic straps lose their strength and begin to stretch under the weight of the pants, a potentially hazardous and uncomfortable condition is created where the pants no longer fit the firefighter as designed.

The present invention contemplates a new and improved suspender which overcomes the foregoing difficulties and others while providing better and more advantageous overall results.

SUMMARY OF THE INVENTION

In accordance with the present invention, a new and improved suspender is provided which comprises at least one shoulder strap, a junction, and at least one back strap. The shoulder strap has a first end and a second end. The shoulder strap is made entirely of an inelastic material. The back strap also has a first end and a second end. Each back strap is made entirely of an inelastic material. Each second end of the shoulder strap and each second end of the back strap is fixedly attached to the junction.

According to a further aspect of the invention, the shoulder straps are padded.

According to a further aspect of the invention, the shoulder strap is comprised of the padding and an outer layer, the outer layer being made of a flame-resistant material.

According to a further aspect of the invention, the padding is made of a flame-resistant material and is constructed of a needle-punched fabric.

According to another aspect of the invention, a belt for use with firefighter's pants comprises a strap portion and a fastening means for fastening. The strap portion has a first and second end and is made entirely of an inelastic material.

According to a further aspect of the invention, the strap portion is padded.

According to a further aspect of the invention, the strap portion is comprised of the padding and of an outer layer. The outer layer is made of a flame-resistant material.

According to a further aspect of the invention, the padding is made of a flame-resistant, needle-punched fabric.

According to a further aspect of the invention, the fastening means is a buckle.

According to a further aspect of the invention, the fastening means is a pair of flame-resistant hook-and-loop strips.

According to a further aspect of the invention, the pair of hook-and-loop strips are of such dimension to allow a degree of adjustability and the operative length of the strap portion so that the belt may be sized to the firefighter's waist.

One advantage of the present invention is improved durability in that the inelastic materials used in the suspenders and in the belt do not become more elastic through use or through the passage of time. This means the suspenders and belt of this invention will continue to perform as new suspenders after many hours of use.

Another advantage of the present invention is reduced cost due to lower inventory. Rather than being made of several materials such as inelastic and elastic, the shoulder straps and back straps of the present invention are made of the same material. This material is often used in the construction of firefighter's pants and coats. Therefore, fewer types of materials must be inventoried in order to produce protective outerwear for firefighters.

Another advantage of the invention is a higher degree of comfort to the wearer in that the shoulder straps of the suspenders and the belt are padded.

Another advantage of the invention is improved safety in that the suspenders and belt are manufactured of a flame-resistant material.

Still other benefits and advantages of the invention will become apparent to those who are skilled in the art upon a reading and understanding of the following detailed specification.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DESCRIPTION OF THE PREFERRED EMBODIMENT

Figure 1:
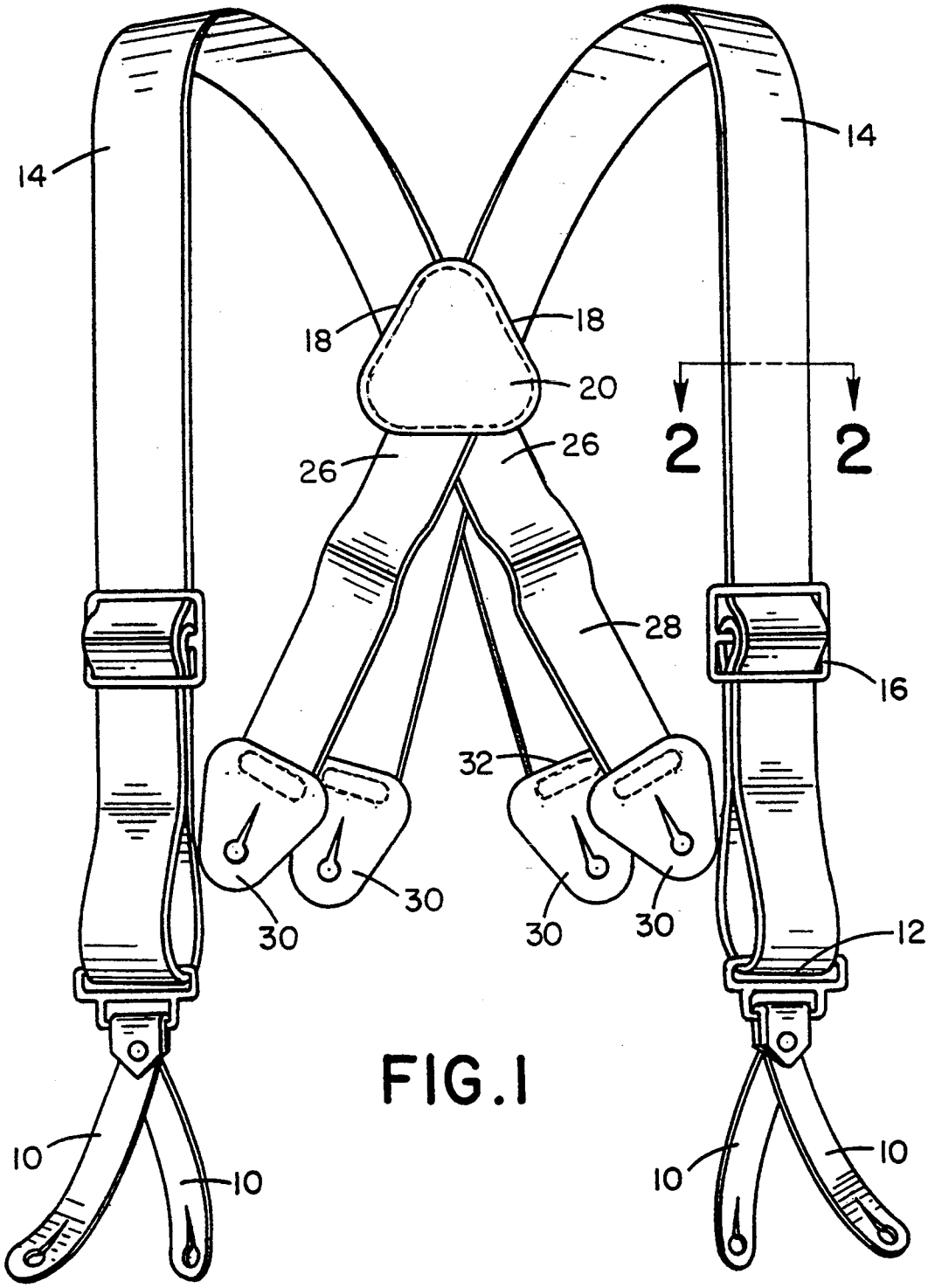
FIG. 1 is a front view of suspenders according to the present invention.

Referring now to the drawings wherein the showings are for purposes of illustrating a preferred embodiment of the invention only and not for purposes of limiting same, FIG. 1 shows the suspenders of the present invention. In a currently unpreferred embodiment, a pair of eyelets 10 are fixedly attached to the first end 12 of each shoulder strap 14. In the preferred embodiment, a single eyelet is fixedly attached to each first end 12. A single eyelet is preferred due to lower cost and ease of use. An adjustment buckle 16 is located near the first end 12 of each shoulder strap 14. The adjustment buckle 16 is operatively adapted for adjusting the length of the shoulder strap. The second end 18 of each shoulder strap 14 is fixedly attached to a junction 20.

In the preferred embodiment, the junction is made of leather and the second end 18 is sewn to the junction 20.

The second end 26 of the back strap 28 is fixedly attached to the junction 20. In the preferred embodiment, the second end 26 of the back strap 28 is sewn to the junction. Eyelets 30 are fixedly attached to the first end 32 of the back strap 28. In the preferred embodiment, the eyelets are made of leather and are sewn to the first end 32.

The eyelets 10, 30 are operatively adapted to cooperate with associated buttons located near the waistband of an associated pair of firefighter's pants. In the preferred embodiment, there are four back straps and two shoulder straps.

In the preferred embodiment, the junction 20 is made of leather. In another embodiment, the junction 20 may be made of an inelastic material, such as the material used for the shoulder and back straps 14, 28.

Figure 2:
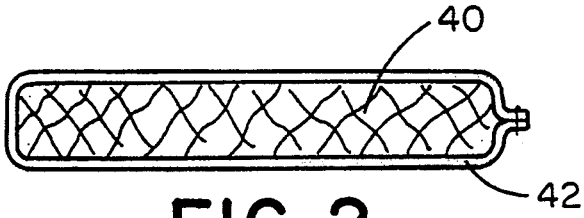
FIG. 2 is an enlarged cross-sectional view of the shoulder strap of FIG. 1 taken along line 2—2 of FIGURE 1.

With reference to FIG. 2, a cross-sectional view of a shoulder strap 14 is shown. The shoulder strap 14 is comprised of padding 40 and an outer layer 42. The padding is made of a flame-resistant material that has been formed into a needle-punched fabric. In the preferred embodiment, the material is a poly amide such as NOMEX III®. NOMEX III® is a registered trademark of the EI DuPont DeNemours & Co. The outer layer is also made of NOMEX III® and can be wrapped around the padding 40 and sewn shut in a variety of ways. The padding 40 adds a measure of comfort to the firefighter.

Figure 3:
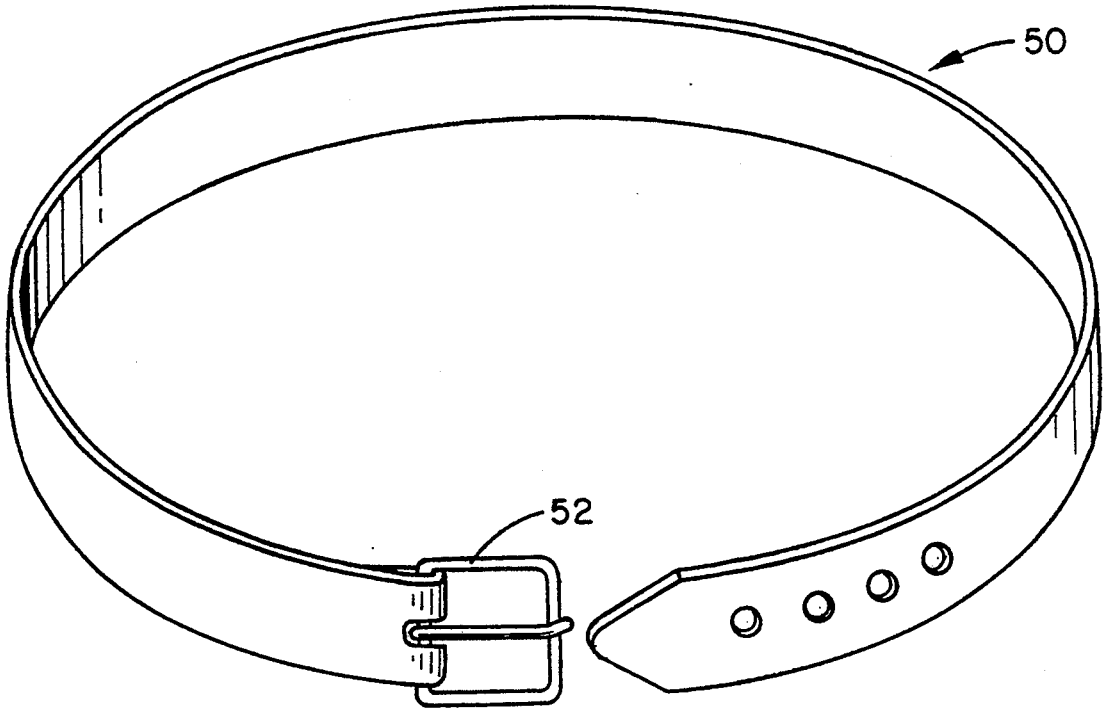
FIG. 3 is a belt according to one embodiment of the invention.
Figure 4:
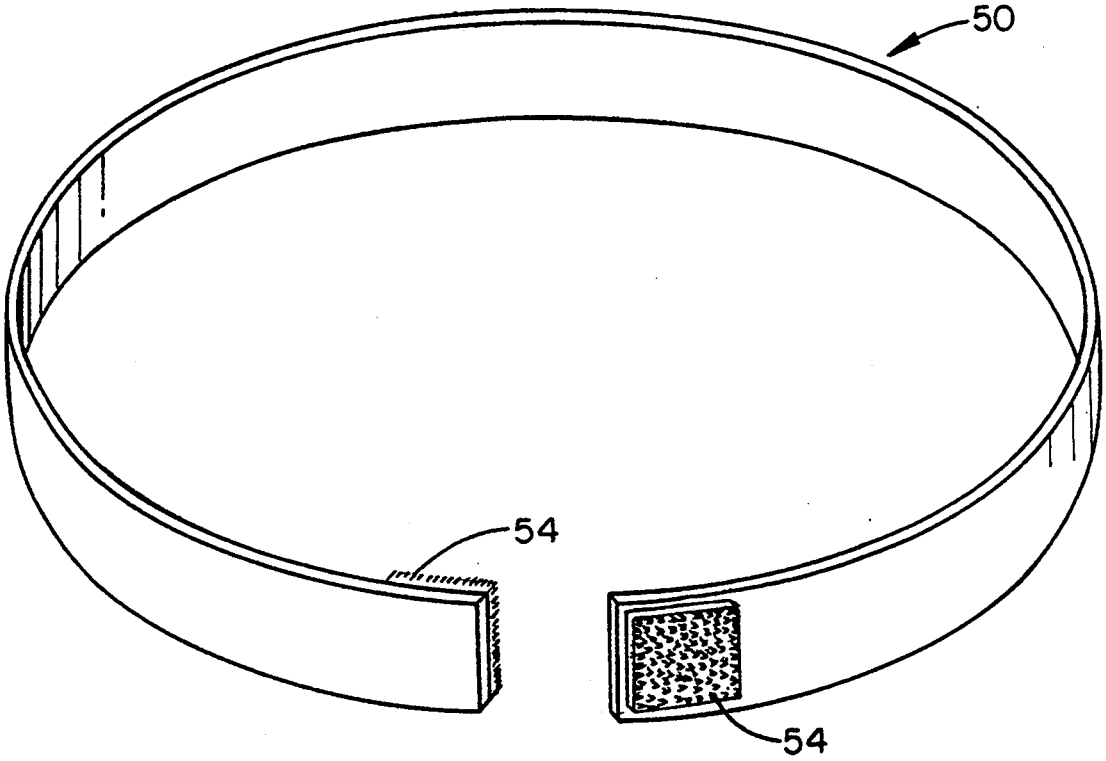
FIG. 4 is a belt according to another embodiment of the invention.

With reference to FIGS. 3 and 4, there is disclosed a belt 50 according to the present invention. The belt has an identical construction as that shown in FIG. 2, namely an inner padding 40 made of a needle-punched, flame-resistant material, and an outer layer 42, also made of a flame-resistant material. FIG. 3 shows a belt 50 with a buckle 52 as the fastening means. In the preferred embodiment, shown in FIG. 4, the fastening means for fastening is a pair of fire-retardant hook-and-loop strips 54. In the preferred embodiment, the hook-and-loop strips are of such a length to allow a degree of adjustability in the operative length of the belt. In this way, a single belt can be sized to fit the waists of a variety of firefighters.

The invention has been described in great detail sufficient to enable one of ordinary skill in the art to make and use the same. Obviously, modifications and alterations of preferred embodiment will occur to others upon the reading and understanding of the subject specification and it is the intention to include all such modifications and alterations as part of the invention insofar as they come within the scope of the appended claims.

Having thus described the invention, it is now claimed:

1. A belt for use with firefighter's pants, the belt comprising:

a strap portion having a first end and a second end, the strap portion made entirely of inelastic material, the strap portion comprising a centrally located padding layer and further comprising an outer layer completely covering the padding layer, the outer layer being made of a flame-retardant material; and, a fastening means for fastening said belt first end to said belt second end, the fastening means fixed to an end of the strap portion and selectively fastening the first end of the strap portion to the second end of the strap portion, whereby the firefighter's pants are secured around the firefighter's waist.

2. A belt as in claim 1 wherein the padding is made of a flame-resistant material.

3. A belt as in claim 2 wherein the padding is made of a needle-punched fabric.

4. A belt as in claim 3 wherein the fastening means is a buckle.

5. A belt as in claim 3 wherein the fastening means is a pair of fire-retardant hook-and-loop strips, one strip affixed to the first end of the belt and one strip affixed to the second end of the strip, the strips being of a length so that the length of the belt is adjustable to the firefighter's waist.

6. A belt for use with firefighter's pants, the belt comprising:

a strap portion having a first end and a second end, the strap portion being comprised of padding and an outer layer completely covering said padding, the outer layer being made of a flame-retardant material; and, fastening means for fastening, the fastening means fixed to an end of the strap portion, the fastening means selectively fastening a first end of the strap portion to a second end of the strap portion, whereby the firefighter's pants are secured to the firefighter's waist.

7. A belt in claim 6 wherein said strap portion is made from entirely inelastic material.

8. A belt as in claim 6 wherein the padding is made of a flame-resistant material.

9. A belt as in claim 8 wherein the padding is made of a needle-punched fabric.

10. A belt as in claim 9 wherein the fastening means is a buckle.

11. A belt as in claim 9 wherein the fastening means is a pair of fire-retardant hook-and-loop strips, one strip affixed to the first end of the belt and one strip affixed to the second end of the strip, the strips being of a length so that the length of the belt is adjustable to the firefighter's waist.

* * * * *